United States Patent [19]

Henkel

[11] 4,150,269

[45] Apr. 17, 1979

[54] STEP-ON FOOT SWITCH

[75] Inventor: Wolfgang Henkel, Erlangen, Fed. Rep. of Germany

[73] Assignee: Siemens Aktiengesellschaft, Berlin & Munich, Fed. Rep. of Germany

[21] Appl. No.: 872,434

[22] Filed: Jan. 26, 1978

[30] Foreign Application Priority Data

Feb. 10, 1977 [DE] Fed. Rep. of Germany ..... 2705575

[51] Int. Cl.[2] ..... H01H 3/14

[52] U.S. Cl. ..... 200/86.5; 200/302

[58] Field of Search ..... 200/85 R, 86 R, 86 A, 200/86.5, 302, 333, 283, 284, 293, 295

[56] References Cited

U.S. PATENT DOCUMENTS

| | | | |
|---|---|---|---|
| 3,083,278 | 3/1963 | Mukai | 200/86.5 |
| 3,808,389 | 4/1974 | Ramsey | 200/302 |
| 3,921,750 | 11/1975 | Shames | 200/86.5 |

FOREIGN PATENT DOCUMENTS

| | | |
|---|---|---|
| 2148760 | 5/1973 | Fed. Rep. of Germany. |
| 2149240 | 3/1974 | Fed. Rep. of Germany. |

*Primary Examiner*—Gerald P. Tolin

*Attorney, Agent, or Firm*—Hill, Gross, Simpson, Van Santen, Steadman, Chiara & Simpson

[57] ABSTRACT

A step-on actuated foot switch is disclosed preferably for use in connection with X-ray examination devices to automatically turn off motor servo drives when an operator's feet are positioned adjacent moving portions of the X-ray examination device. The switch device includes a support plate having a step-on plate suspended above the floor plate and parallel thereto with interposed switching elements which are actuated by relative movement of the two plates. The switch elements are bent spring contact devices which have fulcrum points positioned thereunder about which portions of the spring bend during relative movement of the two plates to break a contact.

13 Claims, 2 Drawing Figures

STEP-ON FOOT SWITCH

BACKGROUND OF THE INVENTION

1. Field of the Invention

This invention relates to switching devices and more particularly to a step-on foot switch.

2. Prior Art

Step-on foot switches are known to the art of industrial technology and are used for numerous purposes such as, for example, automatic door opening devices of the type used at department stores and machine dis-able devices used to turn off machines when entering hazardous areas. Such prior art step-on foot switches have generally been inset into relieved areas of the flooring.

On motor adjustable X-ray equipment, particularly tilt bed patient X-ray devices, there are danger areas in which an operator's foot can become trapped between the floor and moving portions of the machinery. German Auslegeschrift 2,149,240 proposes to protect those areas through the usage of step-on foot switch devices placed on the floor adjacent such areas. Further German Offenlegungsschrift 2,148,760 teaches a foot switch applicable for such uses. This later publication discloses a foot switch which is to be placed on the floor and which is constructed in such a way that electrical contacts positioned between a floor or base plate and a foot plate, held in suspension above the floor plate by springs, are opened when the foot plate is stepped on. However the contact switches used in this prior step-on switch require a considerable minimum constructional height. Although this height is less than if standard commercial switches were used, it nevertheless is sufficiently high as to create the possibility of operator stumbling. Further, in such prior art foot switches for X-ray safety controls, a distinct disadvantage arose from the fact that small objects such as bolts, nuts, screws, dirt, which had fallen to the floor could get under the overlying foot plate thereby preventing proper operation.

It would therefore be an advance in the art to provide a step-on foot switch for such X-ray diagnostic equipment which could be placed on a level floor and which is as flat as possible so as to reduce or eliminate any likelihood that operating personnel will stumble on the switch and to further provide such a switch which is protected from intrusion by objects on the floor.

SUMMARY OF THE INVENTION

It is therefore a principle object of this invention to provide a foot switch providing the above described advance in the art.

In achieving this objective in a step-on foot switch of the type discussed above, the foot plate and base plate are connected around their peripheral edges via a flexible unbroken covering. Slightly bent contact springs are fastened to one of the plates in the intervening space between the two plates. Due to the curvature of the springs, each spring, in an area between its point of attachment and its free end, will contact the other plate. Further in the rest state, the contact springs will have their free ends, as a result of their tension, pressed onto contact strips attached to the opposite plate. Further an interrupter block functioning as a fulcrum is positioned adjacent each of the contact strips in the path of movement of the contact strip. The interrupter block is attached to the plate to which the contact strip is attached.

The manner of contact execution selected as above described wherein the contact spring passes over an interrupter block, makes it possible to reduce the space between the two opposed plates to a dimension between two and four mm without any adverse results as far as operating safety is concerned. Because the space between the opposed plates can be maintained at such a small height, the total height of the switch can thus lie in the range of 0.4 to 0.6 cm. This very small constructional height substantially increases the sensitivity of the switch to intruding particles. Thus a total sealing of the interspace between the two plates is mandatory.

In one preferred embodiment of the invention, the danger of personnel stumbling can be further reduced by providing a surrounding sealing covering which is bent or arced outwardly from the plate somewhat in a toroidal manner. By providing such a shape to the edge seal, the edge seal will function as a deflecting wedge ramp which, when contacted by the tip of the foot of an approaching person, will direct the foot upwardly and onto the foot plate. In this manner the possibility of catching the foot tip on the edge of the switch and the resultant stumbling of the operator will be virtually precluded.

As a further refinement, an additional reduction in the danger of stumbling can be achieved by attaching the sealing strip or covering to respectively the lower face of the base plate and the lower face of the foot plate. As a result the toroid shaped will be brought closer to the floor thus facilitating further, the wedging upward movement of the shoe tip.

In a further development of this invention, the operating reliability of the foot switch can be increased by providing a plurality of contact springs and aligning their associated contact strips parallel to the edge of the foot plate. The switch is most frequently first stepped on at the edge. Thus it is not frequently depressed in the central zones but rather originally in the region of the loaded edge. It is in these edge regions, therefore, that contacts are of primary importance. Moreover, by locating the contacts at the edge, even when the load is applied to the central zones of the overall foot switch, the edge regions will be depressed. The depression of the edge regions with a central loading can be increased by providing stiffening ribs on the foot plate.

Other objects, features and advantages of the invention will be readily apparent from the following description of a preferred embodiment thereof, taken in conjunction with the accompanying drawings, although variations and modifications may be effected without departing from the spirit and scope of the novel concepts of the disclosure, and in which:

DESCRIPTION OF THE PREFERRED EMBODIMENT

Figure 1:
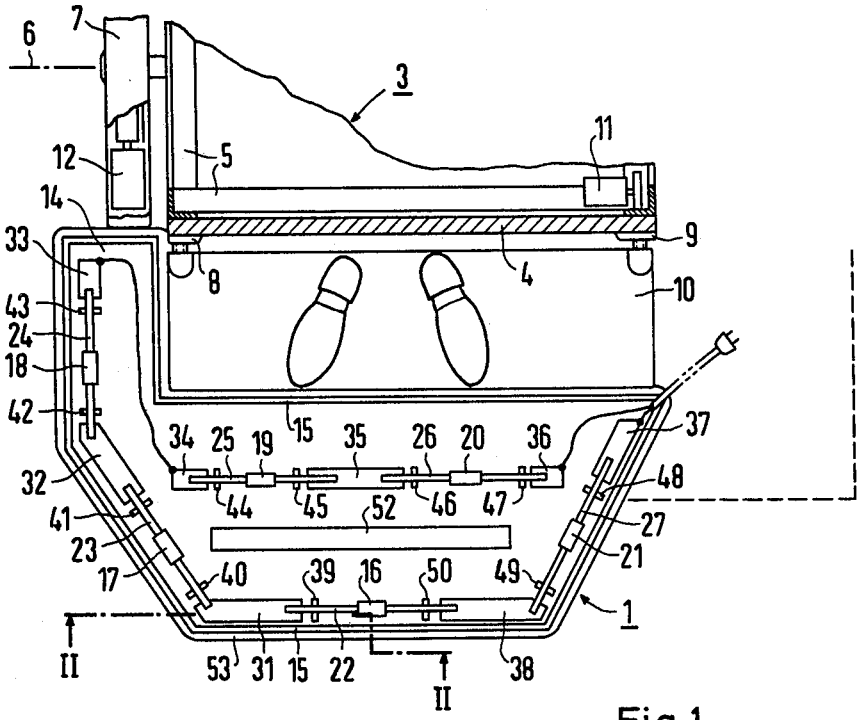
FIG. 1 is a top plan view of a step-on foot switch device according to this invention mounted in front of a X-ray examination device with the foot plate removed from the foot switch.

FIG. 1 is a top plan view of the step-on switch 1 of this invention with the upper or foot plate 2 removed. The switch device is positioned adjacent the front of an X-ray examination machine 3 which is equipped with a tiltable patient support or bed 4. In the illustration of FIG. 1, the patient support bed 4 has been tilted to its vertical standing position and therefore extends perpendicularly to the plane of the drawing of FIG. 1. The patient support bed 4 is mounted on a table frame 5 supported on a pedestal 7 with the bed 4 being tiltable about a horizontal tilt axis 6. Mounting rails 8 and 9 are attached to the longitudinal edges of the support bed 4 and a foot rest 10 is carried by the mounting rails and is movable along with the bed 4. The foot rest 10 and bed 4 are moved by means of motor drive 11. The table frame 5, together with the bed mounted thereon and the foot rest 10 are all rotatable about the tilt axis 6 by means of a further motor drive 12.

When this type of X-ray examination table is used, there always exists the danger that the feet of the operator can become pinched between the foot rest and the floor when the foot rest 10 is lowered. Beyond that, a further danger exists that when the patient's bed is placed in its upright position during a swinging movement of the table frame 5 about the tilt axis 6, an operator's foot can become pinched between the pedestal 7 and the table frame, particularly just prior to achievement of the vertical position shown in FIG. 1.

It is therefore expedient to utilize a foot switch adjacent the areas where such foot pinching can occur and to have the switch control or provide a shut off for one or both of the motors 11 and 12.

Figure 2:
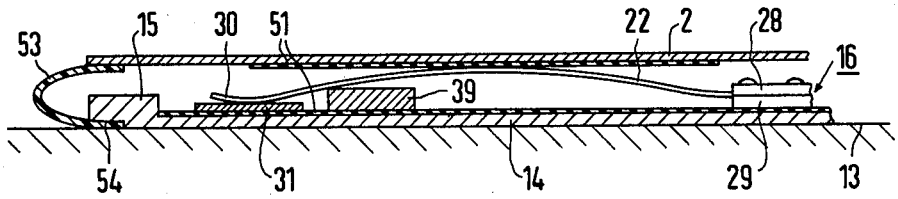
FIG. 2 is a sectional view taken along the lines II—II of FIG. 1 with the foot plate in position.

FIG. 2 illustrates the structure of the switch in a fragmentary cross-sectional view. The switch consists of a base or support plate 14 having a surrounding edge 15. The base 14 rests on the floor 13. Mounts 16 through 21 for contact springs 22 through 27 are attached to the base. The springs 22 through 27 are curved into a slight S shape as illustrated. Each of the mounts consists of two form parts 28 and 29 between which one end of the contact spring is clamped. Because of the elastic force of the contact spring, the contact springs have their free ends resting on contact strips 31 through 38 which are also attached to the base plate 14 spaced from the mountings 16 through 21. Further because of the arched or bent nature of the contact springs, a side of the contact spring opposite the side which contacts the contact strips will engage the undersurface of the top or foot plate 2. The foot plate 2 is preferably co-dimensional with the base plate 14 and is suspended thereabove supported on the arced contact springs. In this manner the arced contact springs hold the foot plate a few millimeters above the base plate. In the process, contact springs 22 through 27 are additionally pressed against the contact strips 31 through 38 by the weight of the unloaded foot plate.

In the immediate vicinity of each contact strip, a fulcrum member or interrupter block 39 through 50 is attached to the base plate 14. The interrupter blocks underlie each of the contact springs and are dimensioned such that with an unloaded foot plate 2, the interrupter block will be just slightly out of contact with its respective contact spring.

Further, in order to provide proper insulation, the opposed surfaces of the foot plate and base plate, at least in the vicinity of the contact springs, are provided with insulation coatings 51.

Additionally, as is illustrated in FIG. 2, the peripheral edge 15 of the base plate may be provided with a raised portion serving as a stop for the top foot plate when the foot plate is loaded. Additionally support bars 52, which may be co-dimensional with the raised periphery 15, may be provided on the support plate 14 in the central area. The bars 52 prevent sagging of the foot plate when it is loaded.

Attached around the periphery of the switch device 1 is a covering 53 which is continuous and without gaps. The covering 53 closes the peripheral area between the base plate 14 and the upper foot plate 2. The covering perferably consists of a thin rubber or synthetic material bead and is attached at both the bottom of the base plate, in a mil slot 54 and to the bottom or undersurface of the foot plate 2. The height of the edge 15 of the base plate 14 with the attached seal member 53 should correspond to the height of the members 52 and the mounts 16 through 21 for the contact springs 22 through 27. In this manner the mounts 16 through 21 can also function as a foot plate support stop. With this dimensioning, the interrupter blocks 39 through 50 which underlie the contact strips may have a height less than the height of the members 52 and the mounting blocks by an amount equal to the thickness of the contact springs.

In a device constructed according to this invention, upon the addition of a load to the foot plate 2, for example when an operator steps on the plate, the contact springs 22 through 27 will be depressed and therefore pressed flat against the blocks 39 through 50. When this occurs the free ends 30 of the contact springs will be lifted from the contact strips 31 through 38 so that current flow between the respective contact spring and contact strip will be interrupted. In the embodiment illustrated, interruption of the circuit is extremely reliable since all of the contact banks, i.e. contact springs and their associated contact strips, are interconnected in series.

When a peripheral loading occurs, the foot plate 2 together with the covering 53 attached to the underside thereof will be supported on the surrounding edge 15 of the base plate 14. When a more central loading of the foot plate occurs, the foot plate will be additionally supported on the bars 52 and on the mounts 16 through 21. By providing a sufficiently tightly grouped arrangement of support points, sagging of the foot plate can be avoided even when the foot plate is relatively thin. Additionally, where necessary, stiffening bars can be attached to the underside of the foot plate which can also act as support stop bars to resist foot plate sagging. The stiffening bars are not illustrated herein for clarity reasons.

The margin seal or covering 53 effectively prevents small objects such as bolts, screws, nuts, paper clips and the like, which may have fallen to the floor, from getting between the foot plate 2 and the support plate 14. Otherwise, in view of the extremely flat construction of the switch device, such objects could prevent proper depression of the foot plate upon loading, particularly if they came to rest on the raised marginal edge 15. Moreover, because of the outwardly projecting toroidal shape of the seal 53, it will fulfill an additional function. In the manner of a wedge, it will guide the tip of an approaching foot onto the foot plate 2 thereby avoiding any abutment of the shoe with the switch edge. This beneficially reduces the possibility of operating stumbling even in those instances where the operator, or patient walks with an aggravating shuffling manner.

It can therefore be seen from the above that this invention provides a novel, extremely low step-on switch which is simple in its construction and particularly well adapted for use in association with moving bed diagnostic X-ray devices.

Although the teachings of my invention have herein been discussed with reference to specific theories and embodiments, it is to be understood that these are by way of illustration only and that others may wish to utilize my invention in different designs or applications.

I claim as my invention:

1. In a step-on actuated foot switch of the type used for automatically disengaging motor servo drives on X-ray examination devices in case of danger which includes a base plate resting on a floor adjacent the examination device and a foot plate suspended above the base plate parallel thereto with switching elements intermediate the foot plate and base plate actuatable by relative movement of the two plates, the improvement of the foot plate and base plate being interconnected entirely around a common periphery by a flexible gapless seal member extending from the foot plate to the base plate, the switching elements including arched contact springs each having portions thereof fastened to one of the plates with at least one free end projecting from the point of attachment between the two plates curving from the point of attachment outwardly into contact with the plate to which the spring is attached, and then back towards the plate to which the spring is attached terminating in a free end, contact strips carried by the plate to which the springs are attached underlying respective free end and being contactable by the free end when the foot plate is fully suspended above the base plate, interrupter blocks attached to the plate to which the contact springs are attached, said interrupter blocks underlying the contact springs adjacent the contact strips intermediate the point of attachment of the contact springs and the free ends, the interrupter blocks effective to lift the free end out of contact with the contact strips when the top plate is depressed towards the base plate.

2. A switch according to claim 1 wherein the seal member is arched outwardly from the remainder of the switch with an arch peak forming an outer periphery for the switch.

3. The switch of claim 2 wherein the seal member has ends attached respectively to an undersurface of the foot plate adjacent a margin of the foot plate and to an undersurface of the support plate adjacent a margin of the support plate.

4. A switch according to claim 1 wherein a plurality of contact springs and associated contact strips are provided and are arranged substantially parallel to the edges of the foot plate and positioned adjacent thereto.

5. A device according to claim 4 wherein individual switch banks consisting of a contact spring and an associated contact strip are interconnected in series with one another.

6. A switch according to claim 1 wherein the contact springs and interrupter blocks are attached to the base plate.

7. A device according to claim 1 wherein the base plate and foot plate are the same size having equal marginal edges.

8. A switch according to claim 1 wherein the seal member consists of synthetic material film.

9. A switch according to claim 1 wherein the seal member is formed of rubber.

10. A step-on actuated foot switch comprising top and bottom relatively spaced co-dimensional plates, the bottom plate having attached thereto a plurality of contact springs having a point of attachment and projecting free ends, the contact springs being arched between the point of attachment and the free end, the arc projecting away from the bottom plate, a plurality of contact strips attached to the bottom plate underlying the free ends of the contact springs, a plurality of interrupter blocks attached to the bottom plate adjacent the contact strips underlying portions of the contact springs intermediate the point of attachment and the free end, the interrupter blocks having a height projecting above the base plate greater than a height projecting above the base plate of the contact strips, the top plate suspended on the contact springs above the interrupter blocks by a distance greater than the thickness of the contact springs, the top plate moveable towards the bottom plate against the resilient resistance of the contact springs by application of a load to the top plate, movement of the top plate towards the bottom plate forcing the contact springs against the interrupter blocks and effective to lift the free ends off the contact strips, a marginal seal extending around the switch between the top plate and bottom plate sealing the interspace between the top plate and the bottom plate, the marginal seal formed of flexible material facilitating movement of the top plate towards and away from the bottom plate, and an electrical circuit interconnected through the contact springs and contact strips.

11. The device according to claim 10 wherein the seal member is a strip having longitudinal edges connected respectively to an undersurface of the bottom plate and to an undersurface of the top plate and having an intermediate portion between the longitudinal edges projecting outwardly away from the switch forming a marginal boundary for the switch and having a cross-sectional shape effective to aid in guiding the foot of a switch approaching person from the floor surface to the top plate.

12. The device of claim 11 wherein marginal portions of the bottom plate are raised providing a stop member supporting the top plate in a depressed position when a load is applied to the top plate.

13. The device of claim 12 wherein the undersurface of the base plate is provided with a marginal cut out ledge for receipt of one longitudinal edge of the seal member, the cut out ledge having a height substantially equal to the thickness of the seal member.

* * * * *